US005911312A

United States Patent [19]

Holyfield

[11] Patent Number: 5,911,312

[45] Date of Patent: Jun. 15, 1999

[54] PROTECTIVE CLOTHING FOR ELDERLY AND INFIRM PATIENTS

[76] Inventor: Ollie M. Holyfield, 14406 164th Pl. SE., Renton, Wash. 98059

[21] Appl. No.: 08/824,271

[22] Filed: Mar. 26, 1997

[51] Int. Cl.[6] ..... A41D 1/00; A41D 3/00; A41D 13/02

[52] U.S. Cl. ..... 2/69; 2/75; 2/80; 2/83; 2/79

[58] Field of Search ..... 2/1, 69, 69.5, 105, 2/106, 104, 75, 80, 83, 113, 114, 115, 79, 227, 84, 48

[56] References Cited

U.S. PATENT DOCUMENTS

| | | | |
|---|---|---|---|
| 1,288,408 | 12/1918 | Hait et al. . | |
| 2,015,532 | 9/1935 | Rickért | 2/78 |
| 2,106,553 | 1/1938 | Le Coney | 2/78 |
| 2,116,360 | 5/1938 | Lindh | 2/78 |
| 2,474,724 | 6/1949 | Carter | 2/112 |
| 4,304,006 | 12/1981 | Swart | 2/49 |
| 4,743,239 | 5/1988 | Cole | 604/385 R |
| 4,912,780 | 4/1990 | Falack | 2/102 |
| 5,048,122 | 9/1991 | Prieur | 2/114 X |
| 5,418,978 | 5/1995 | Hochman | 2/69 |
| 5,605,060 | 2/1997 | Osborne | 2/69 X |

OTHER PUBLICATIONS

Gershman, Maurice, "Self–Adhering Nylon Tapes." The Journal of the American Medical Association, Vol. 168, No.7, Oct. 1958, p. 930.

Advertisement, Aug/Sep. 1996 in the Washington Voice Newsletter,"The Caresuit" by Pacific Careline.

*Primary Examiner*—Jeanette Chapman
*Attorney, Agent, or Firm*—R. Reams Goodlee, Jr.

[57] ABSTRACT

Protective clothing for use in care of elderly and infirm patients. In one embodiment, clothing is provided without any front entry, and with a rear entry slit that has one or more protective flaps which cover and protect a fastener from manipulation by the patient. Preferably, the garment has an elongated zipper running vertically along the center of the rear. The zipper closure is toward the top, ending adjacent the collar of the garment. One or more, and preferably at least three flaps are provided, anchored on one side of the rear of the garment and disposed to fold substantially horizontally across the zipper, and having hooks provided on the flap to releasably fasten to matched loops located in the other side of the rear of the garment. These protective flaps hinder elderly and infirm patients from engaging the zipper slide so as to loosen and ultimately remove the garment. In another embodiment, the substantially vertical rear entry opening is secured with a button/button-hole fastening system. A security flap is provided near the top of the garment, preferably so as to cover the upper three or more buttons along the primary flap. The security flap has reverse mounted buttons for releasably fastening into the opposing side of the rear of the garment, so as to prevent the patient from unbuttoning the primary buttons, so as to loosen the garment. I have also provide protective undergarments for use in releasably securing diapers to an adult patient.

12 Claims, 14 Drawing Sheets

PROTECTIVE CLOTHING FOR ELDERLY AND INFIRM PATIENTS

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

TECHNICAL FIELD OF THE INVENTION

This invention relates to a novel protective clothing for the elderly and the infirm. Such clothing is particularly well suited for use with mentally disabled patients, due to improved placement of closures, clasps, and fasteners.

BACKGROUND OF THE INVENTION

A continuing demand exists for protective clothing for the elderly and the infirm, particularly for the mentally deficient patients that may be incontinent or without sufficient mental faculties to enable reasonable control over bodily functions. This problem is increasing as large segments of the population are living longer and end up requiring extended nursing care. This problem still exits today, even though various protective clothing designs have been widely used for years.

Currently, when it becomes necessary to keep clothing on a mentally disabled patient, caregivers must resort to using a plurality of fasteners, or other difficult to manipulate systems, none of which seem to reliably work. So, constant vigilance is required, which is another workload factor for caregivers. In general, such heretofore used protective clothing and the methods for their use are not designed for effectively preventing the patient from removing the clothing, and thus their use has certain drawbacks.

In general, the previously utilized protective clothing designs which are known to me have left something to be desired. Thus, it would be desirable for a number of reasons to be able to provide improved protective clothing which hinders or makes it impossible for the patient to remove the clothing. First, an improved garment fastening system could significantly decrease the caregiver labor required for re-clothing certain patients. Second, protective clothing that is difficult or impossible for elderly to remove make it possible to have adequate clothing on the patient at all times. Finally, caregiver personnel would not have to worry about having to constantly re-dress patients, or clean up areas which have become contaminated with excrement or bodily fluids by mentally incapacitated patients. Consequently, I have developed a design for a novel body suit, and a design for closure of the same which hinders or prevents the elderly and the infirm from removing the same. The apparatus of the present invention overcomes the limitations of the prior art by providing a protective outer garment which is essentially unremovable by the patient. Thus, the advantages offered by my novel protective clothing and their fastening techniques, and which may be provided in various sizes which are easily serviced by caregivers, are important and self-evident.

SUMMARY OF THE INVENTION

In one embodiment, the invention described and claimed herein amounts to an article of clothing which has a rear entry, a rear fastening mechanism, and a rear latching mechanism. A body suit is provided with either long sleeves or short sleeves, and with an extended rear zipper from the rear collar to near rear crotch. Above the the upper reaches of the zipper, a plurality of flaps are provided to be securely folded over the zipper and hooked, so as to secure the left rear size to the right rear side (or vice versa).

My novel protective clothing designs are simple to fabricate, in a variety of sizes, are relatively inexpensive, and are easy to fit on to patients, and are easy to remove and to clean, and are otherwise superior to the heretofore used or proposed elderly protective clothing designs of which I am aware. My protective clothing designs are a significant improvement in clothing practices for institutions caring for the elderly and the infirm.

OBJECTS, ADVANTAGES, AND FEATURES OF THE INVENTION

From the foregoing, it will be apparent to the reader that one important and primary object of the present invention resides in the provision of new and useful protective clothing which can substantially prevent removal by a patient, which can be custom manufactured to fit the particular size needs of a patient, yet while achieving the desired fit.

Other important but more specific objects of the invention reside in the provision of protective clothing suits for the elderly and the infirm which:

- can substantially prevent removal by the user;
- can be provided with a simple fastening mechanism so that caregivers can easily place patients into such clothing, and can easily remove patients from such clothing;
- are relatively simple, particularly in the manufacture and installation, to thereby enable the clothing to be easily fabricated in a variety of styles and sizes.

Other important objects, features, and additional advantages of my invention will become apparent to the reader from the foregoing and from the appended claims and as the ensuing detailed description and discussion proceeds in conjunction with the accompanying drawing.

BRIEF DESCRIPTION OF THE DRAWING

In the drawing.

In the various figures of the drawing, identical features will be indicated with the same reference numerals, without further mention thereof.

DETAILED DESCRIPTION OF THE INVENTION

Figure 1:
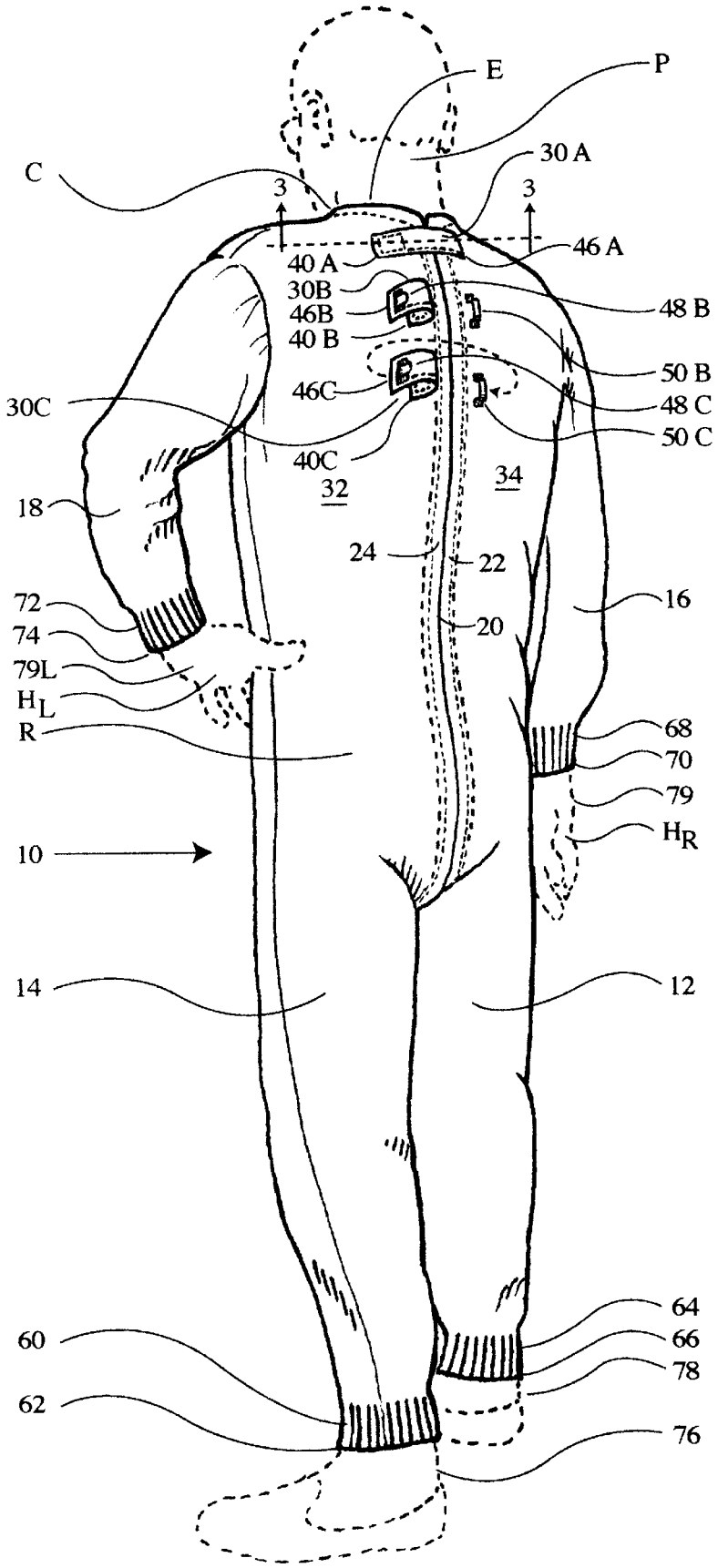
FIG. 1 is a perspective view of the rear of one embodiment of my protective clothing design, showing the use of flaps over the zipper to secure the garment on the patient.

Referring now to the drawing, FIG. 1 depicts, during patient dressing, my novel protective body suit 10, provided here an entryless front portion F, to which are attached, or with which are integrally formed, full length right leg 12 and left leg 14 portions, as well as full length right arm sleeve 16 and left arm sleeve 18 portions. The suit 10 can be provided in any desirable weight and type of cloth, but I prefer use of denim, or of cotton/polyester blend, or a heavy knit cotton or cotton/polyester. Preferably along the center 20 of the rear R, a generally vertically extending closeable entry/exit slot opening is provided, defined by opposing right edge 22 and left edge 24 portions. As detailed in the cross-sectional view illustrated in FIG. 3, ideally a vertically extending fastener system, such as a slide fastener system (zipper Z) having right zipper portion 26, a slide 27, and a left zipper portion 28 are affixed at or near right edge 22 and left edge 24, respectively. The zipper Z is closed by urging the zipper handle 29 and attached zipper slide 27 toward the top or upper edge E of collar C of the suit 10, and the zipper Z enables a care giver to easily and reversably open and close the entry/exit slot.

Figure 3:
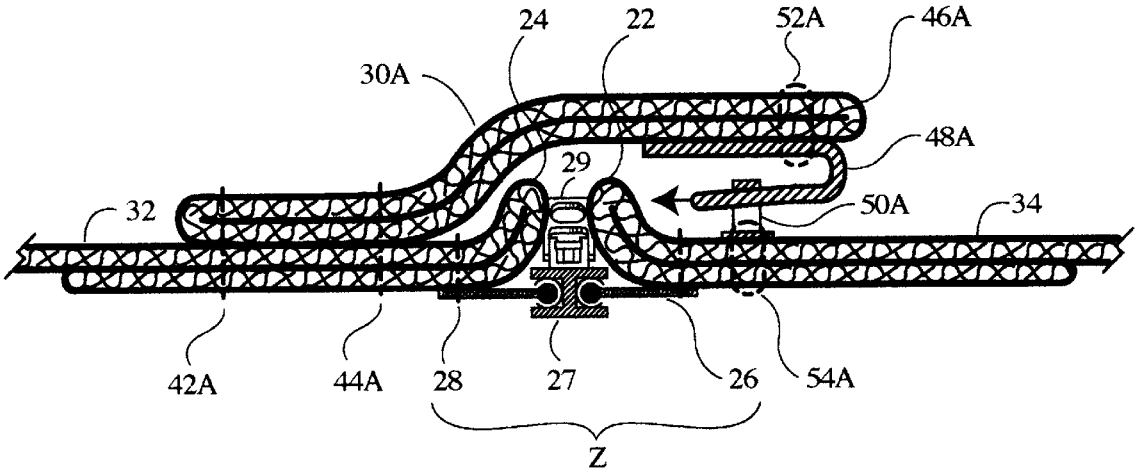
FIG. 3 is a cross-section detail of the rear of the garment just shown in FIG. 1 above, taken as if looking up across line 3—3 of FIG. 1, showing in detail the closure mechanism of the garment.

Returning now to FIG. 1, security flaps 30A, 30B, and 30C are provided to extend across the zipper Z from one side to the other, and as shown, preferably individually rather than collectively, and from the left side 32 to the right side 34 of protective body suit 10. Each of flaps 30A, 30B, and 30C is preferably provided in a substantially parallelpiped shape, with a first end such as left end 40A, 40B, and 40C, respectively, which is attached, preferably by threads 42A, 42B and 42C, and by threads 44A, 44B, and 44C, to the left side 32 of suit 10, as can be understood by reference to threads 42A and 44A as illustrated in FIG. 3. Near the distal or right end 46A, 46B, and 46C, a preferably U-shaped hook 48A, 48B, and 48C is provided in each of flaps 30A, 30B, and 30C, respectively. Hooks 48A, 48B, and 48C clasp preferably C-shaped loops 50A, 50B, and 50C respectively, to secure flaps 30A, 30B, and 30C into a closed position, again as made clear with reference to flap 30A illustrated in FIG. 3. The zipper Z is preferably provided in a substantially vertical orientation, as depicted in FIG. 1, but this may be somewhat varied as desired. However, I have found it advantageous to place the zipper Z in the center of the rear R of protective suit 10, so as to maximize the difficulty of the patient P reaching the suit with their hands. Hooks 48A, and like devices in other flaps 30B and 30C are secured by any convenient fastener, such as rivets 52A, etc. Loops 50A and like devices in other flaps 30B and 30C are secured by any convenient fastener, such rivets 54A, etc.

When the patient P is in suit 10, and flaps 30A, 30B, and 30C are closed, most patients P find it difficult to move their right hands $H_r$ and left hands $H_1$ to manipulate the flaps 30A, 30B, and 30C, so as to disengage the hooks 48A, 48B, and 48C from loops 50A, 50B, and 50C, respectively. This effectively prevents patient P from removing the suit, since they cannot usually downwardly move the zipper slide mechanism 27 unless flaps 30A, 30B, and 30C are opened.

For comfort, a snug elastic band 60 is disposed about left leg opening 62, and a snug elastic band 64 is disposed about right leg opening 66. Similarly, elastic band 68 is disposed about right arm opening 70, and elastic band 72 is disposed about left arm opening 74. The elastic bands 60 and 64 hold the suit 10 against the legs 76 and 78 of patient P, and elastic bands 68 and 72 hold the suit 10 against the right arm 79R and left arm 79R, respectively.

Figure 2:
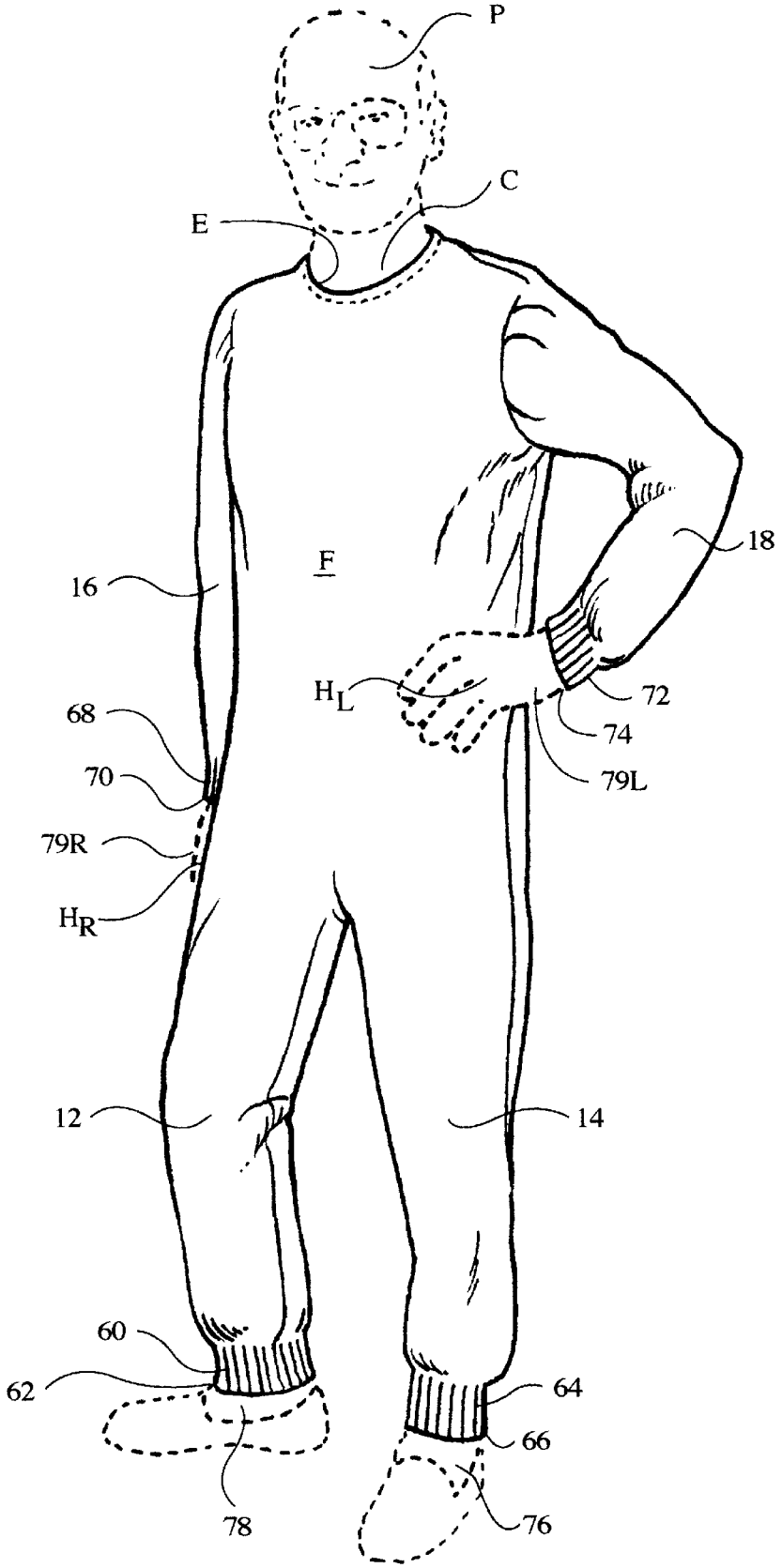
FIG. 2 is a front perspective view of the garment just illustrated in FIG. 1, showing the garment in use on a patient.

Turning now to FIG. 2, the front view of my novel protective garment 10 is illustrated. A relatively high collar C is provided, and it can be seen that the front F of the garment 10, is provided absolutely without any way of entry into or exit from the garment, and absolutely without any zippers, buttons, or other fasteners for the patient P to fiddle with, whether by way of hands or feet.

Figure 6:
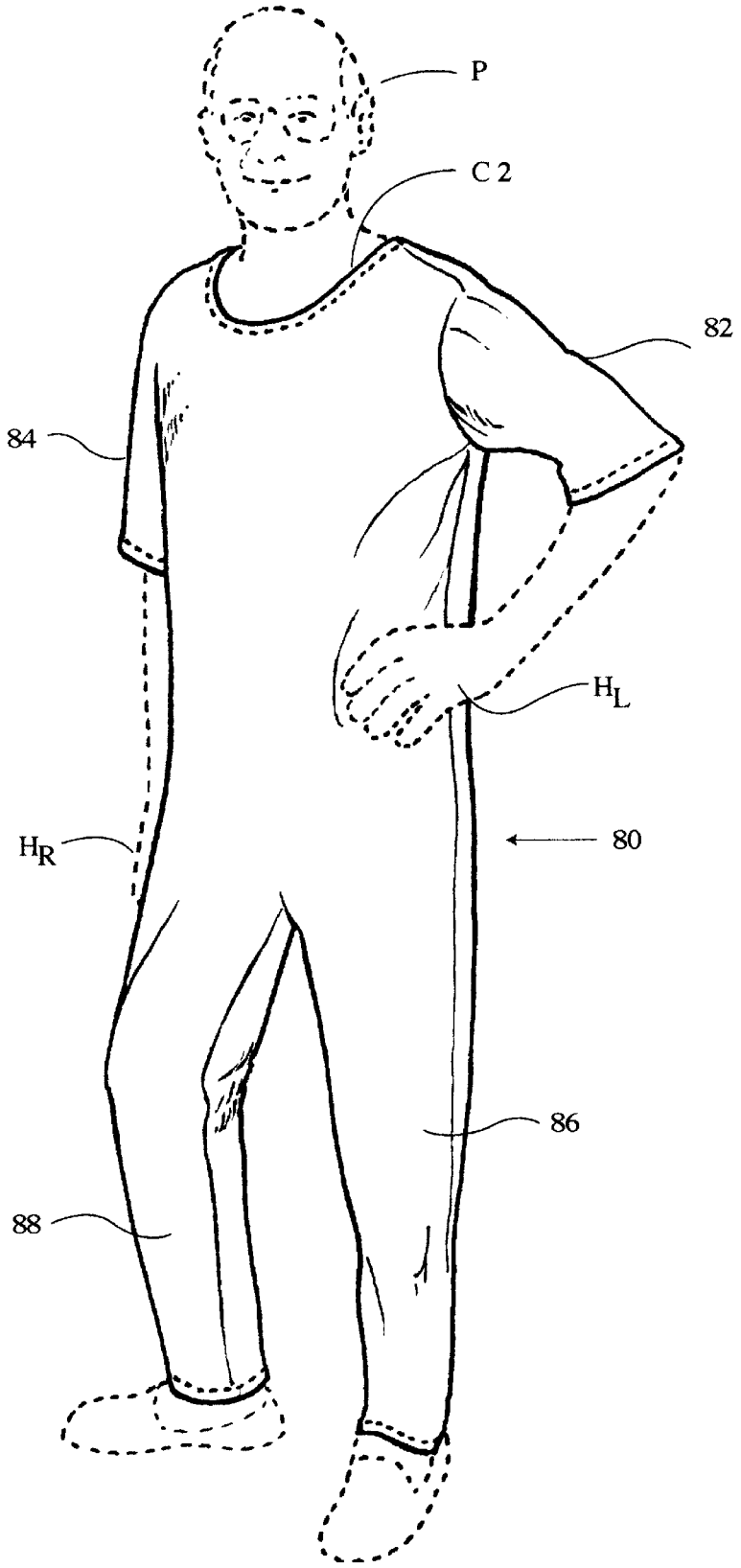
FIG. 6 shows another embodiment of my protective garment, shown with a lower collar, short sleeves, and without elastic leg bands.

For cold weather wear, collar C is preferably high, as indicated in FIG. 1. However, as seen in FIG. 6, for warmer weather, a similar protective suit 80 can be provided with lowered collar $C_2$, and with short sleeves 82 and 84. Also, in the warm weather garment shown in FIG. 6, it is seen that legs 86 and 88 are provided without elastic bands.

Figure 7:
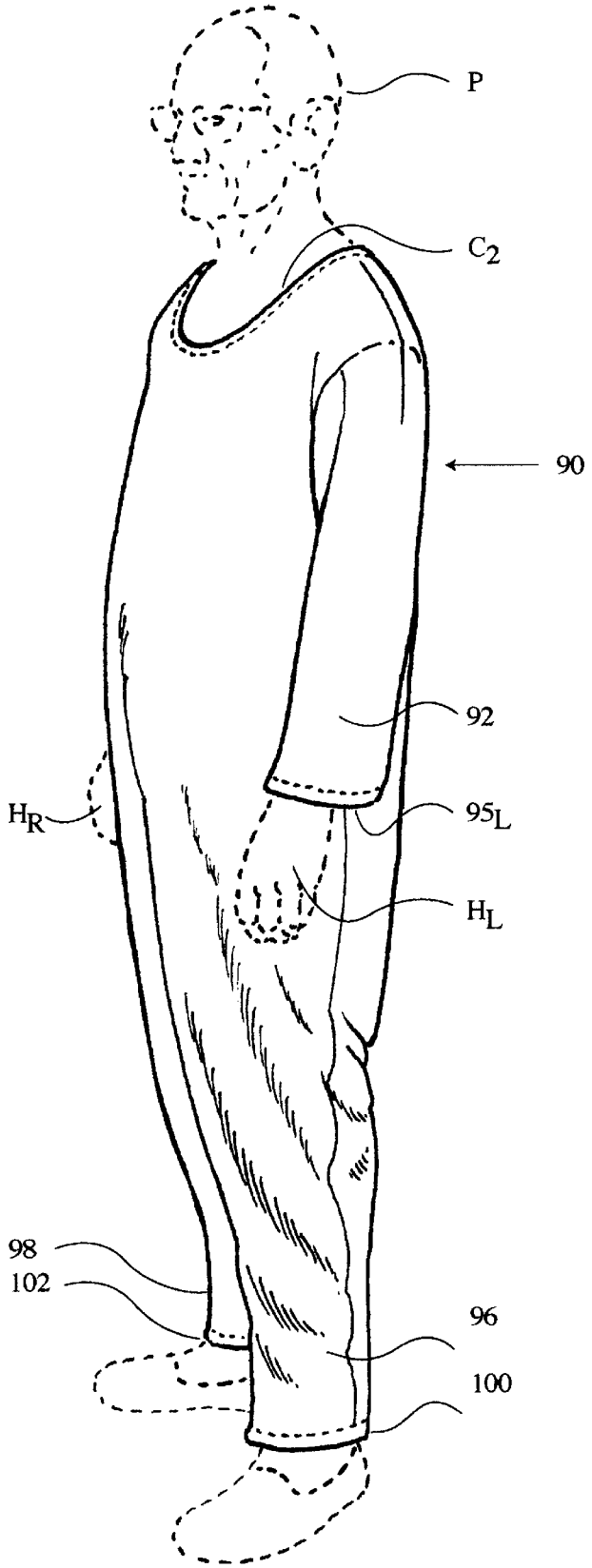
FIG. 7 is still another embodiment of the protective clothing, similar to the embodiment just set forth in FIG. 6 and having a collar design similar thereto, but now showing a three-quarter length type sleeve.

Another embodiment of my protective suit, provided for intermediate temperatures, is illustrated in FIG. 7. Here, protective suit 90, is illustrated, with a warm weather low cut collar $C_2$ again provided; however, left sleeve 92 and right sleeve 94 (not shown) are provided in a three-quarter length size with open ends $\mathbf{95}_l$ and $\mathbf{95}_r$ (not shown). Also, left legs 96 and right leg 98 are provided without any elastic bands at the distal ends thereof, respectively left leg end 100 and left leg end 102, to allow air circulation between the patient P and the protective suit 90. with elastic bands 100 and 102. Again, the closing and clasping mechanism is preferably provided as first illustrated in FIGS. 1 and 3 above.

Figure 4:
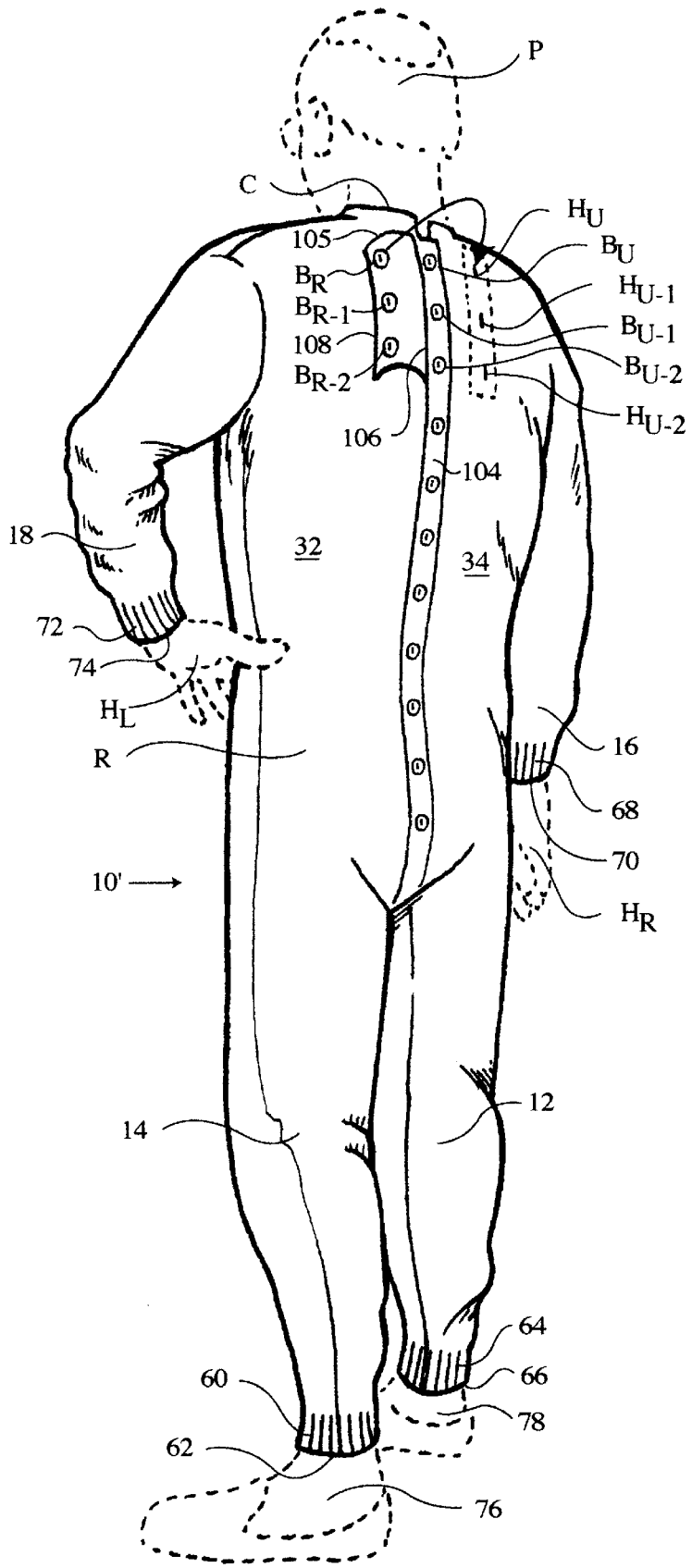
FIG. 4 is another embodiment of the protective clothing, similar to the embodiment first set forth in FIG. 1, but now shown with a buttoned rear design, rather than a zippered rear design.
Figure 5:
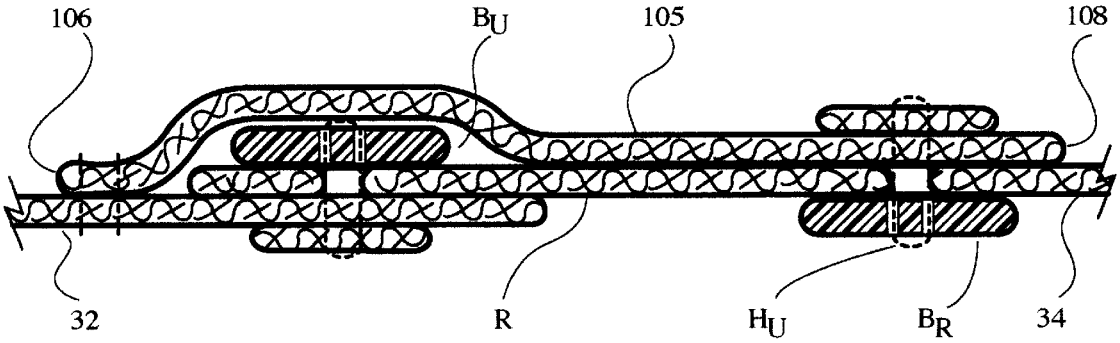
FIG. 5 is a cross-section detail of the rear of the garment just shown in FIG. 4, taken as if the garment were buttoned in a closed position.

An alternative closure mechanism for the protective suit 10 is illustrated in conjunction with protective suit 10' as noted in FIGS. 4 and 5. Instead of use of a slide fastener such as zipper Z, buttons B are used for securing (a) a vertically extending entry slot 104, and (b) top security flap 106. The top security flap 106 is designed for covering an upper button $B_U$, and at least a few downwardly extending buttons in a series of buttons along the entry slot, $B_{U-x}$, such as $B_{U-1}$, $B_{U-2}$, to $B_{U-x}$, etc., wherein x is a positive integer and the total number of buttons along the entry slot equals x+1. The top security flap 106 preferably covers at least the upper three buttons on the suit 10'. Security flap 105 is preferably provided in a substantially parallelpiped shape, having (a) a first side 106 affixed to the rear R of garment 10', such as at the left 32 side of the rear R, as illustrated, and (b) a second or distal end 108. One or more reverse mounted buttons in a series of buttons $B_R$, $B_{R-1}$, $B_{R-2}$, to $B_{R-y}$, wherein y is zero or a positive integer and is one less than the total number of buttons along the rear of the security flap, and preferably (but not necessarily) corresponding in number to the number of buttons in the series $B_U$, $B_{U-1}$, $B_{U-2}$, etc. (which are to be covered by the security flap 105) are provided, preferably mounted adjacent the distal end 108 of security flap 105, for reverse entry through companion button holes $H_U$, $H_{U-1}$, $H_{U-2}$, to $H_{U-y}$ etc. This button style construction, with the reverse security flap 105, also provides the necessary degree of difficulty for most elderly and infirm patients, so as to prevent their removal of the protective suit 10'. Details of the closure mechanism just described are set forth in FIG. 5. It must be appreciated that although use of a single security flap 105 is illustrated, flaps could also be provided in independent, single button construction, similar to the concept depicted in FIG. 1 above.

Figure 9:
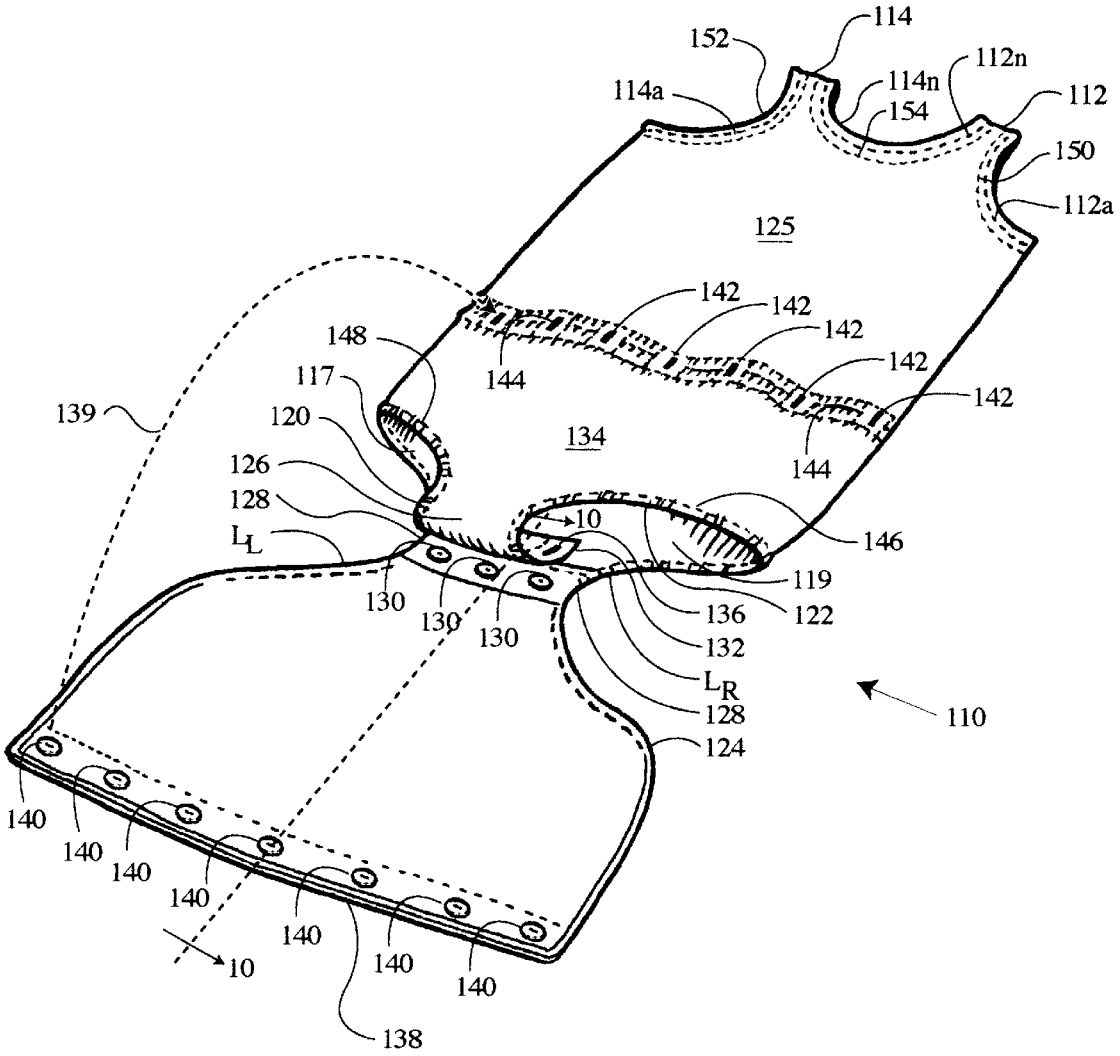
FIG. 9 shows the clothing design first shown in FIG. 8, but showing in detail the closure mechanism at the rear of the garment.
Figure 10:
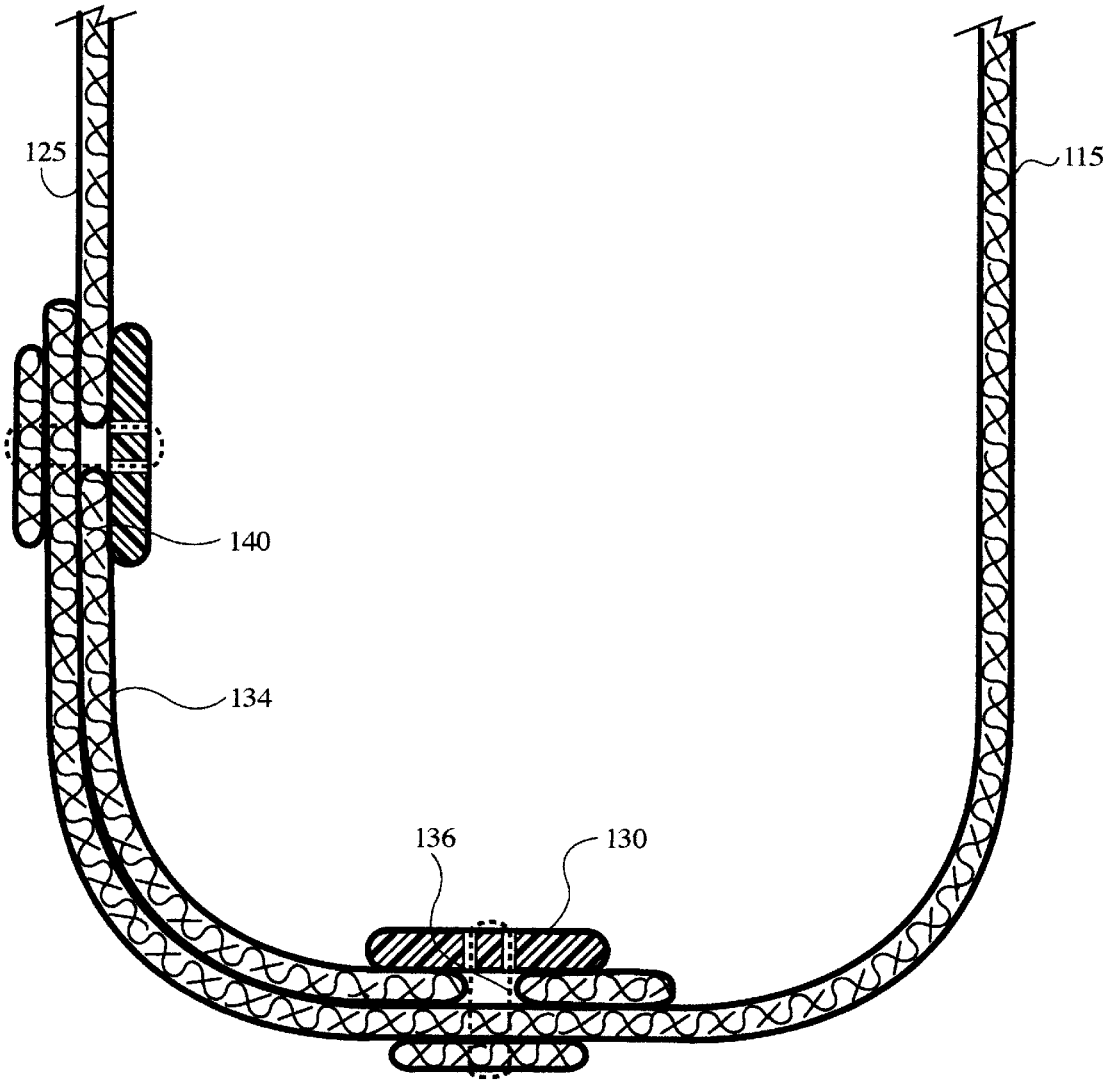
FIG. 10 depicts the detail of the crotch and rear closure mechanism of the garment just shown in FIGS. 8 and 9 above.
Figure 11:
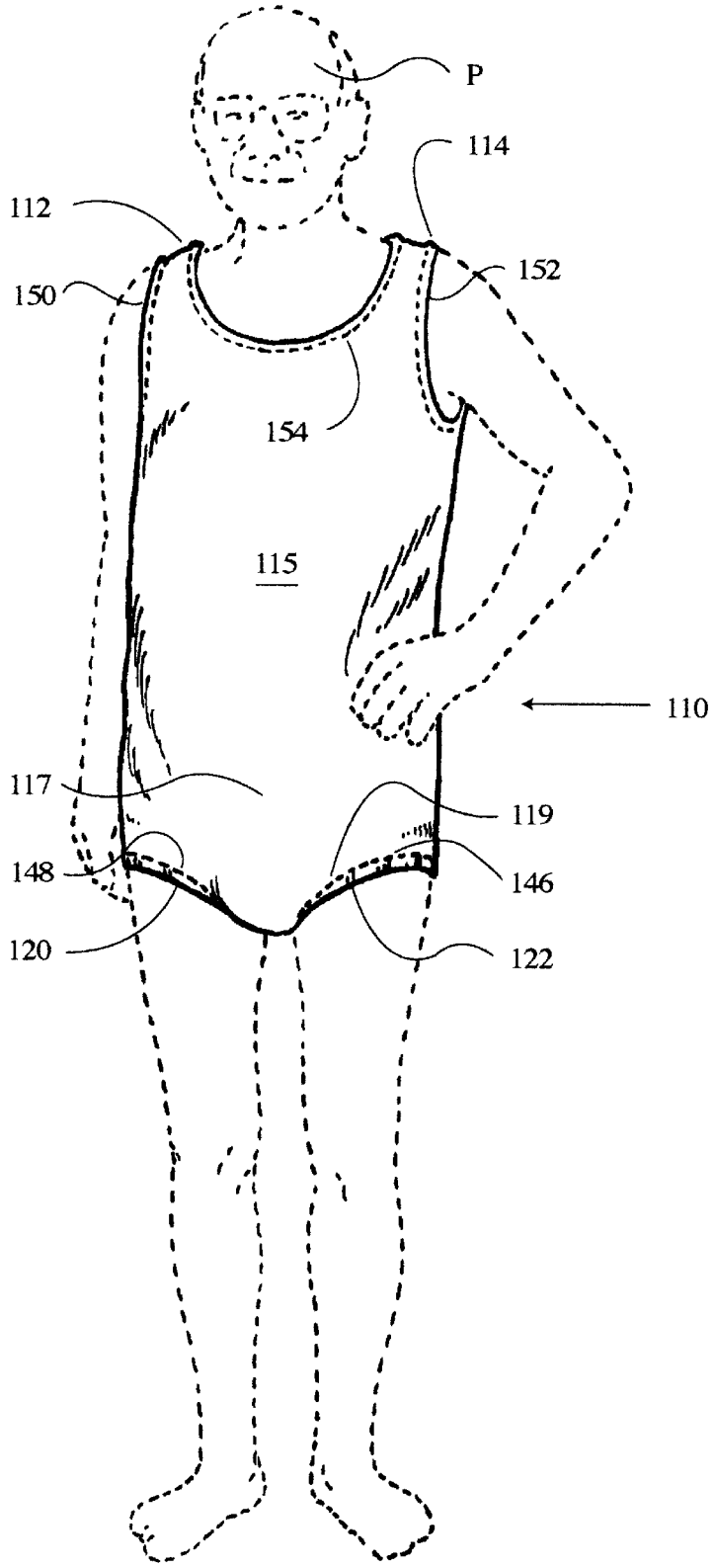
FIG. 11 is front perspective view of the garment just shown in FIGS. 8, 9 and 10, now showing the garment in use on a patient.

Turning now to FIGS. 8, 9, 10, and 11, a protective undergarment 110 for incontinent patients is shown. This protective garment 110 has a shoulder loops 112 and 114 for support from shoulders 116 and 118 of patient P. As seen in FIG. 11, the undergarment 110 has a smooth front 115 with no fasteners or closure mechanisms for the patient P to fiddle with to inadvertently open so as to remove protective undergarment 110. This garment 110 is primarily used to fasten adult incontinent pads (diapers) to hold them in place on patients P who try to remove their diapers, and who, with most prior art garments, actually succeed.

Details of protective undergarment 110 are seen in FIG. 9. The front 115 narrows along the lower and outer reaches thereof at the right 117 and the left 119 sides to form notches 120 and 122 for leg openings. The lower reaches of bottom 134 of upper rear portion 125 narrows to form a downwardly extending rear flap crotch portion 126, at which point the bottom 134 terminates. Along narrowed, isthmus shaped narrowed lower crotch portion 128, located between leg openings $L_l$ and $L_r$, and between the front 115 and lower rear portion 124, a first series of fasteners such as interior buttons 130 are utilized to attach end 132 of crotch flap 126, via matching buttonholes 136.

Figure 9A:
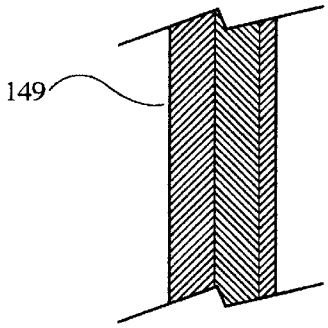
FIG. 9A shows a high strength woven backing tape for use in strengthening shoulders of the garment shown in FIGS. 8 and 9.

The interior buttons 130 are actually hidden in use by the upward extension end 138 of the outer, lower rear portion 124. This is accomplished by the upward extension of the lower rear portion 124 to a fastened, in-use position, wherein fasteners such as rear buttons 140, having been moved upward in the direction of reference arrows 139, are secured at fastener companion devices, here shown as rear button holes 142. Elastic bands 144 are provided for urging the rear R against patient P. Likewise, elastic is preferably included in the crotch area, such as via elastic bands 146 and 148. For reinforcement, and particularly to keep the protective garment 110 from tearing when shoulder loops 112 and 114 are used to assist in lifting a patient, each of loops 112 and 114 are preferably reinforced with a high strength backing tape 149, as indicated along stitch lines 150 and 152, with respect to the arm openings, and at stitch line 154, with respect to the collar C opening. As noted in FIG. 9A, the high strength backing tape 159 is preferably a flat, woven fabric strip which can be sewn along both the neck edges ($\mathbf{112}_n$ and $\mathbf{114}_n$ and both arm edges $\mathbf{112}_a$ and $\mathbf{114}_a$ of the shoulder loops 112 and 114. Normally, edges $\mathbf{112}_n$ and $\mathbf{114}_n$ are formed in a continuous collar loop, or spliced at a single joint around a collar.

This protective garment 110 enables provision of diapers on patients, while substantially preventing such patient from manipulating the fastening system on the protective undergarment 110 so as to be able to remove the underlying diapers.

Figure 8:
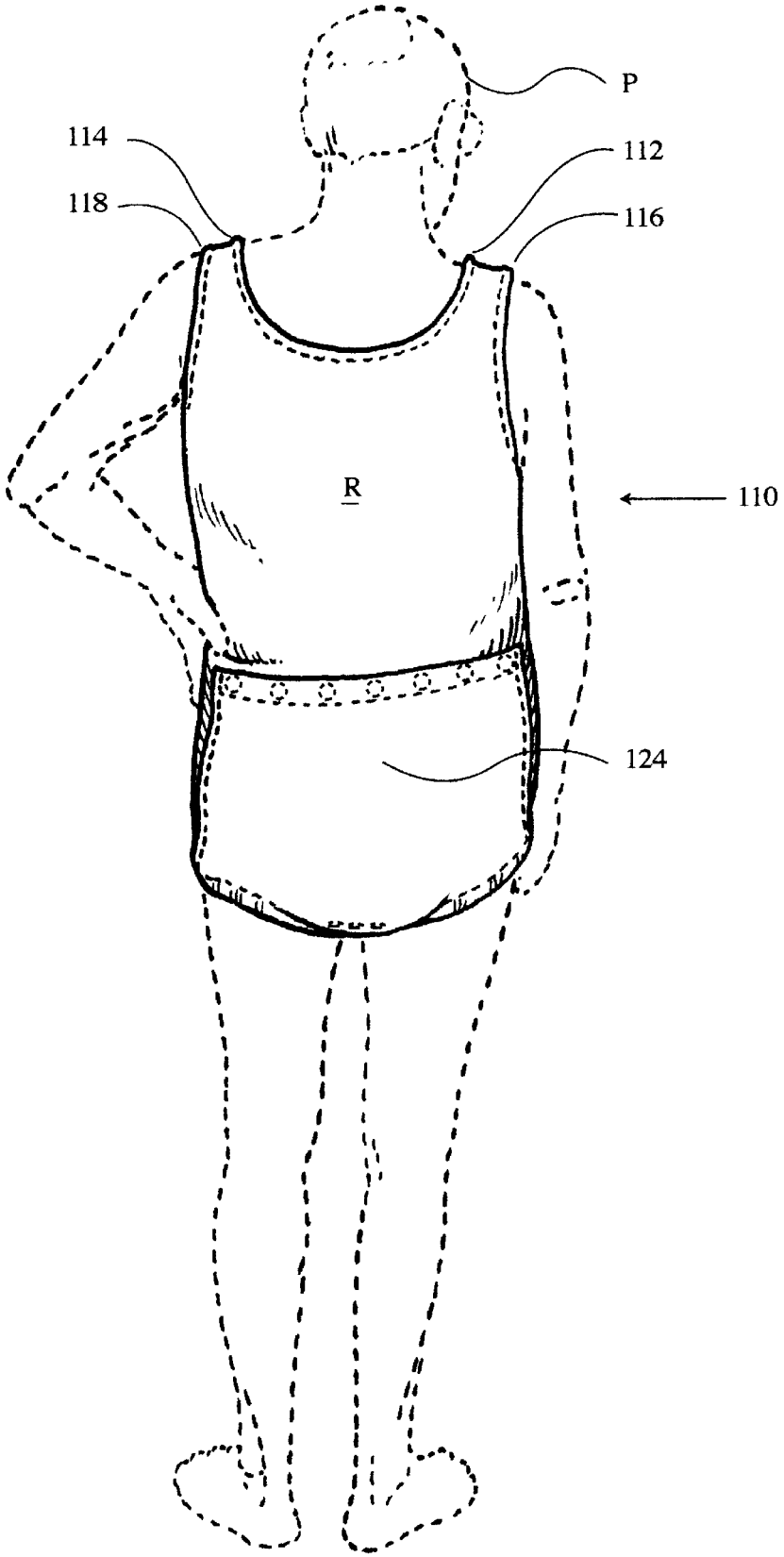
FIG. 8 depicts another protective clothing design, particularly helpful for use with incontinent adults, where the clothing fastens at the crotch and in the rear, making it very difficult for most elderly and infirm patients to remove the same.

The undergarment 110 inseam and back closure cross section is depicted in FIG. 10, which is taken as if across line 10—10 of FIG. 9, but with the protective undergarment 110 having been secured in a fastened, close position as shown in FIG. 8. Here in FIG. 10, the rear button 140 can be seen in place in rear button hole 142. Likewise, interior button 130 is seen in place in interior button hole 132, so as to completely close the undergarment 110 in the rear R thereof, so as to make it difficult for patient P to remove the undergarment 110.

Figure 12:
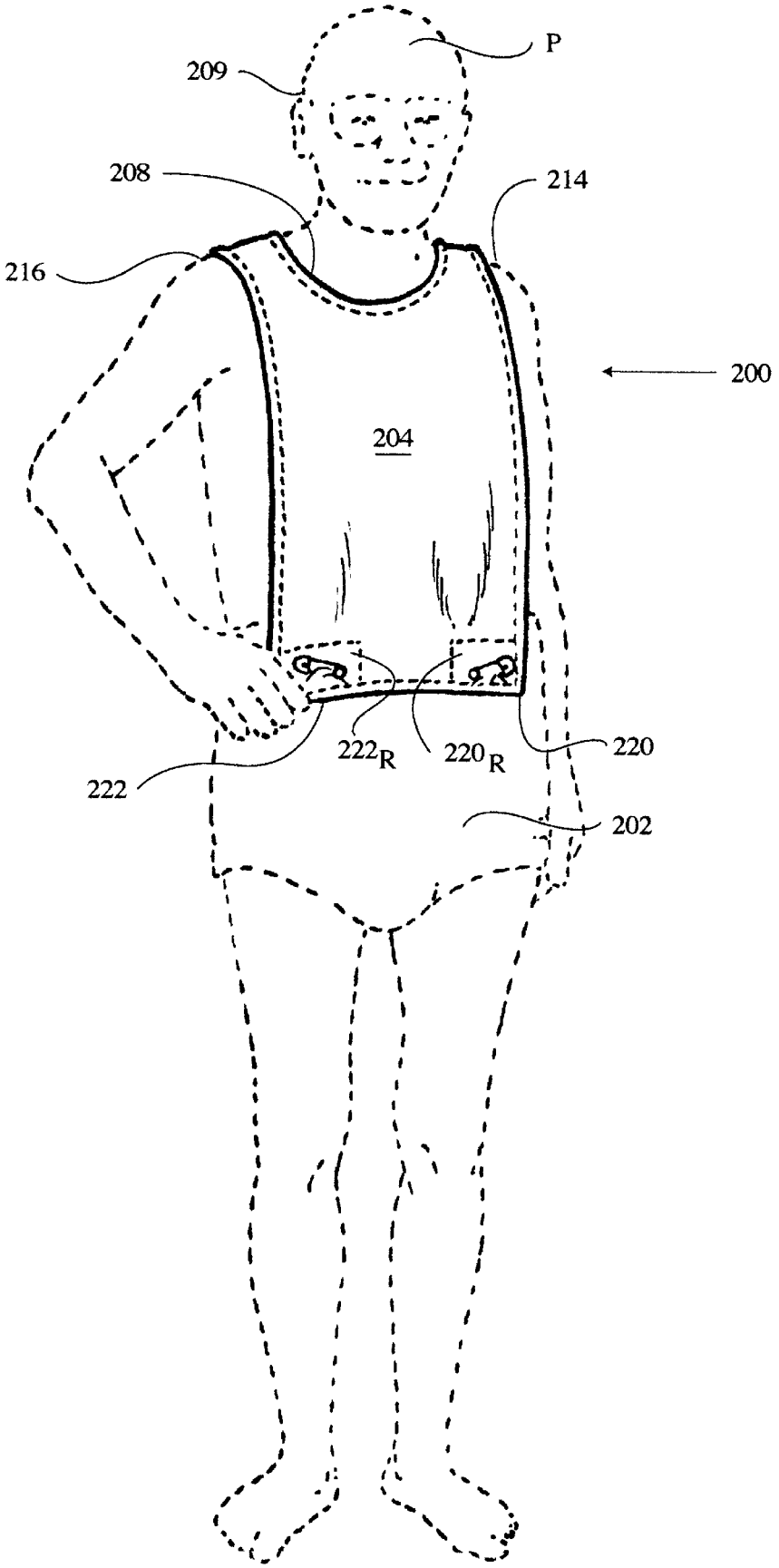
FIG. 12 is a front perspective view of a protective vest used to keep adult incontinent pads secured to a patient.
Figure 13:
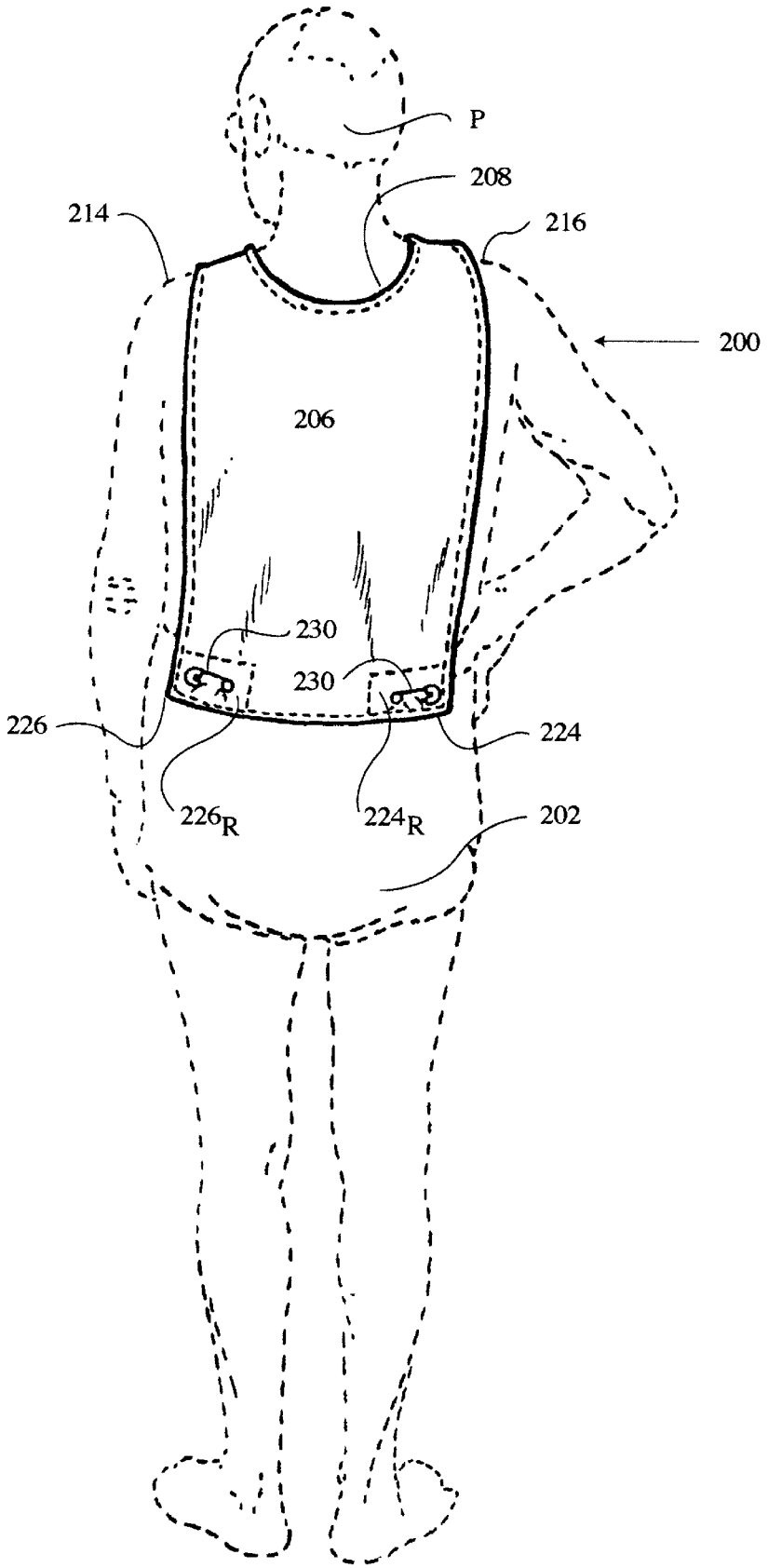
FIG. 13 is a rear perspective view of the protective vest just shown in FIG. 12.
Figure 14:
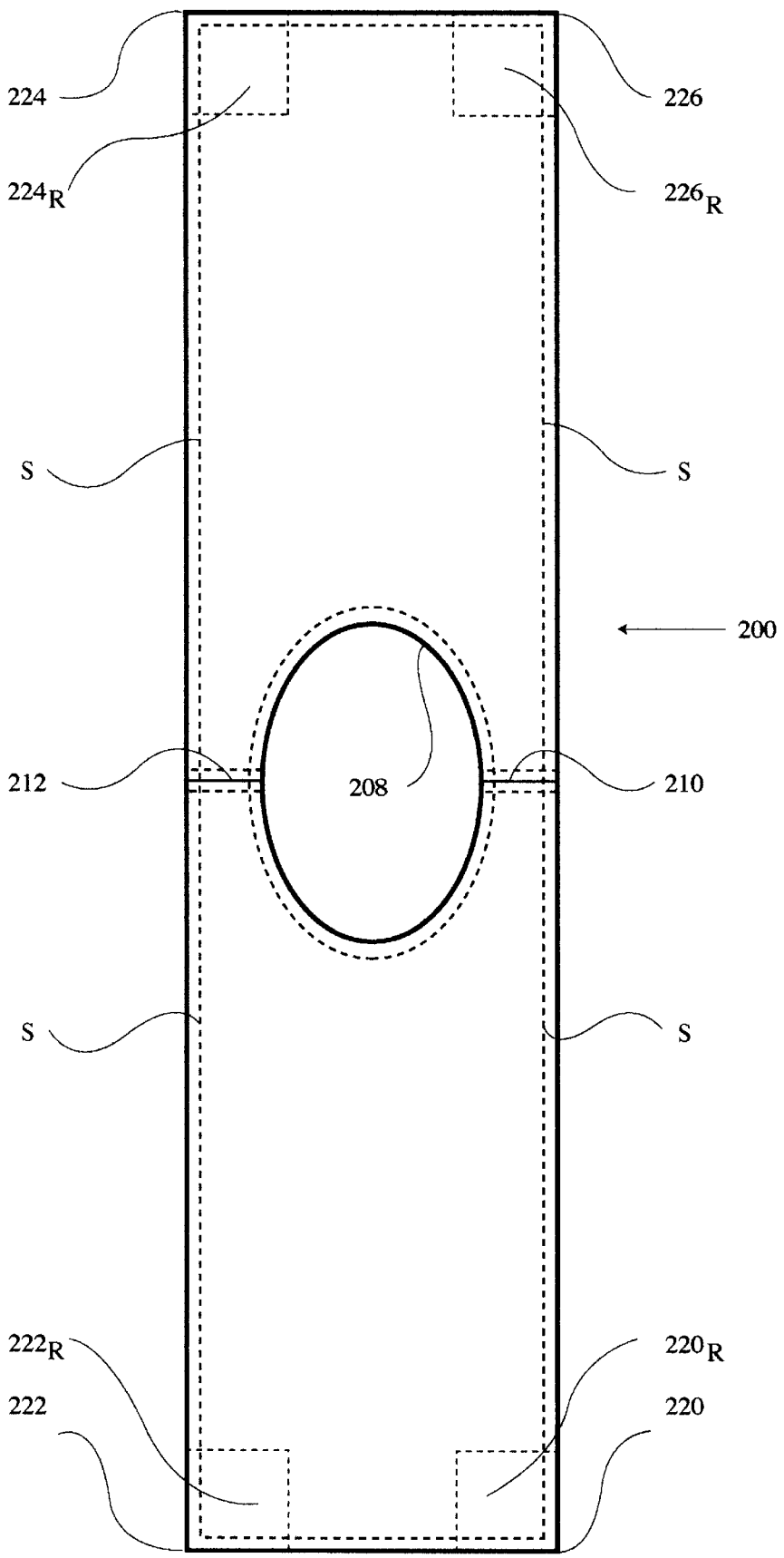
FIG. 14 shows the pattern design for the vest just described in FIGS. 12 and 13, as if laid out flat for cutting and assembly.

Turning now to FIGS. 12, 13, and 14, yet another protective vest garment 200 is illustrated. Protective vest 200, like protective undergarment 110, is useful for securing adult incontinent pads 202 against removal by patient P. Vest 200 includes a front panel 204 and opposing rear panel 206, with a substantial head opening formed by collar edge portion 208 of sufficient size to allow a particular patient P's head 209 to pass therethrough. Narrow, elongated shoulder strips 210 and 212 are thereby defined for draping vest 200 over the shoulders 214 and 216 of patient P. The vest 200 has, at the lower left 220 and right 222 front corners, and lower left 224 and right 226 rear corners, corresponding extra thickness reinforced sections $\mathbf{220}_R$, $\mathbf{222}_R$, $\mathbf{224}_R$, and $\mathbf{226}_R$, adapted to repeatedly receive safety pins 230 therethrough without significant degradation over moderate periods of use.

Although vest 200 can be cut in any desired shape, I have found it economical to use a substantially parallelpiped shaped structure with center hole 232 defined by collar edge 208. For assurance of strength when using the vest 200 to assist in moving patients P, I recommend use of a high strength reinforcing bias tape edge, depicted by stitching S, such as is noted in FIG. 9A above.

In any event, it will thus be seen that the objects set forth above, including those made apparent from the proceeding description, are efficiently attained, and, since certain changes may be made in carrying out the construction of protective clothing generally in the manner described, and while still achieving the objectives as set forth herein, it is to be understood that the invention may be embodied in other specific forms without departing from the spirit or essential characteristics thereof. For example, while I have set forth exemplary designs for several embodiments of a piece of protective clothing, many other embodiments are also feasible to attain the result of the principles of the protective clothing design disclosed herein. Therefore, it will be understood that the foregoing description of representative embodiments of the invention have been presented only for purposes of illustration and for providing an understanding of the invention, and it is not intended to be exhaustive or restrictive, or to limit the invention to the precise forms disclosed. On the contrary, the intention is to covet all modifications, equivalents, and alternatives falling within the spirit and scope of the invention as expressed in the appended claims.

The claims are intended to cover the structures and methods described therein, and not only the equivalents or structural equivalents thereof, but also equivalent structures or methods. Thus, the scope of the invention, as indicated by the appended claims, is intended to include variations from the embodiments provided which are nevertheless described by the broad meaning and range properly afforded to the language of the claims, or to the equivalents thereof.

What is claimed is:

1. A protective garment for use by an elderly or infirm patient said garment comprising:

(a) a fabric body, said body further comprising (i) a left full length leg portion, (ii) a right full length leg portion, (iii) a left arm portion, said left arm portion comprising a lower portion joining said body at a left armpit location, and (iv) a right arm portion, said right arm portion comprising a lower portion joining said body at a right armpit location;

(v) an entryless, loose fitting front portion, and said front portion having an upper edge for defining a collar portion at upper reaches thereof, and (vi) a rear portion, said rear portion having an upper edge for defining a collar at the upper reaches thereof, said upper edge joining, at the left and rights sides of said rear portion, the collar portion of said front portion, and said rear portion further comprising a vertically extending entry slot extending downward from said collar and defined by opposing edge portions;

(b) a vertically extending fastener system, said fastener system extending along and cooperating with said opposing edge portions of said vertically extending entry slot in said rear portion, and operable to reversably open and close said entry slot;

(c) at least two security flaps each of said security flap comprising a first end, said first end attached to said rear portion on a first side of said opposing edge portions of said entry slot, and a second end, said second end further comprising at least one fastener, said at least one fastener of each of said at least two security flaps removably secured to a second side of said opposing edge portions of said entry slot, each of said at least two security flaps vertically and only, situated from said collar to a location at least as high as said left or said right armpit locations.

2. The protective garment as set forth in claim 1, wherein said vertically extending fastener system comprises a vertically extending slide fastener, said vertically extending slide fastener extending along and fastened to said opposing edge portions of said vertically extending entry slot in said rear portion, and operable to reversably open and close said entry slot.

3. The protective garment as set forth in claim 1, wherein said vertically extending fastener system comprises a plurality of buttons, and a plurality of buttonholes, said buttonholes sized to match said buttons so as to securely and reversably receive said buttons therethrough, so as to releasably secure said vertically extending entry slot in a closed position.

4. The protective garment as set forth in claim 1, wherein said at least two security flaps each comprise a single hook type fastener, and wherein said rear portion further comprises a complementary, generally C-shaped receiving single loop portion, said hook portion and said receiving loop portion sized so that said hook is reliably received in said loop portion so as to secure said at least one security flap.

5. The protective garment as set forth in claim 4, wherein at least three security flaps are provided.

6. The protective garment as set forth in claim 3, wherein said plurality of buttons comprises an uppermost button $B_U$ and a downwardly directed series of subsequent buttons $B_{U-x}$, wherein the total number of buttons equals x+1, wherein x is a positive integer, and wherein said security flap further comprises a one or more reverse mounted buttons, the uppermost button being $B_R$ and one or more reverse mounted buttons extending downwardly, if more than one reverse mounted button is provided, through a series of subsequent buttons through final button $B_{R-y}$, wherein the total number of reverse mounted buttons equals y+1, wherein y equals 0 or a positive integer, and wherein said reverse portion of said protective garment comprises a companion series of button holes $H_U$ through $H_{U-y}$ for receiving said reverse mounted buttons $B_R$ through $B_{R-y}$, and wherein said one or more reverse mounted buttons are adapted to releasably fasten said at least one security flap across said vertically extending fastener system, so as to prevent said vertically extending fastener system from being manipulated by a patient.

7. The protective garment as set forth in claim 1, wherein said left leg portion and said right leg portion each further comprise a distal end opening, and wherein adjacent said distal end opening, an elastic band is provided, said elastic band adapted to urge said protective garment toward the legs of a patient.

8. The protective garment as set forth in claim 1, wherein said left arm portion and said right arm portion each further comprise a distal end opening, and wherein adjacent said distal end opening, an elastic band is provided, said elastic band adapted to urge said protective garment toward the arms of a patient.

9. The protective garment as set forth in claim 1, wherein said left arm portion and said right arm portion each are provided in a short sleeve configuration.

10. The protective garment as set forth in claim 1, wherein said left arm portion and said right arm portion each are provided in a three-quarter length sleeve configuration.

11. The protective garment as set forth in claim 1, wherein said collar portion of said front portion is provided in a low-cut configuration, for loose fitting about the neck of a patient.

12. The protective garment as set forth in claim 4, wherein each of said at least one security flaps is oriented in a direction substantially perpendicular to said vertically extending fastener system.

* * * * *